US009570277B2

(12) United States Patent
Bark et al.

(10) Patent No.: US 9,570,277 B2
(45) Date of Patent: Feb. 14, 2017

(54) SYSTEM AND METHOD FOR MALDI-TOF MASS SPECTROMETRY

(71) Applicant: University of Houston System, Houston, TX (US)

(72) Inventors: Steven J. Bark, Houston, TX (US); Charles C. King, Leucadia, CA (US)

(73) Assignees: UNIVERSITY OF HOUSTON SYSTEM, Houston, TX (US); THE REGENTS OF THE UNIVERSITY OF CALIFORNIA, Oakland, CA (US)

( * ) Notice: Subject to any disclaimer, the term of this patent is extended or adjusted under 35 U.S.C. 154(b) by 0 days.

(21) Appl. No.: 14/711,487

(22) Filed: May 13, 2015

(65) Prior Publication Data

US 2015/0332906 A1 Nov. 19, 2015

Related U.S. Application Data

(60) Provisional application No. 61/992,402, filed on May 13, 2014.

(51) Int. Cl.

| | |
|---|---|
| ***H01J 49/00*** | (2006.01) |
| ***H01J 49/16*** | (2006.01) |
| *H01J 49/40* | (2006.01) |

(52) U.S. Cl.

CPC ..... *H01J 49/0036* (2013.01); *H01J 49/0027* (2013.01); *H01J 49/0031* (2013.01); *H01J 49/164* (2013.01); *H01J 49/40* (2013.01)

(58) Field of Classification Search

CPC .. H01J 49/164; H01J 49/0027; H01J 49/0031; H01J 49/0036; H01J 49/40

See application file for complete search history.

(56) References Cited

U.S. PATENT DOCUMENTS

| | | | | |
|---|---|---|---|---|
| 5,625,184 | A * | 4/1997 | Vestal | H01J 49/164 250/282 |
| 6,680,476 | B1 * | 1/2004 | Hidalgo | H01J 49/0036 250/281 |
| 6,806,465 | B2 * | 10/2004 | Anderson | H01J 49/0022 250/287 |
| 7,412,334 | B2 * | 8/2008 | Fjeldsted | H01J 49/0036 250/281 |
| 7,463,983 | B1 * | 12/2008 | Patrick | H01J 49/40 702/28 |

* cited by examiner

*Primary Examiner* — Jack Berman

(74) *Attorney, Agent, or Firm* — Conley Rose, P.C.

(57) ABSTRACT

A system and method for matrix assisted laser desorption time-of-flight (MALDI-TOF) mass spectrometry. A method for MALDI-TOF mass spectrometry includes initiating a spectral analysis of a sample on a MALDI-TOF spectrometer. The sample is ionized, and a first ion spectrum is detected and stored. Thereafter, the spectrometer is reset, and the ionizing, detecting, storing, and resetting are repeated until a predetermined plurality of spectra of the sample is acquired.

20 Claims, 4 Drawing Sheets

SYSTEM AND METHOD FOR MALDI-TOF MASS SPECTROMETRY

CROSS-REFERENCE TO RELATED APPLICATIONS

The present application claims priority to U.S. Provisional Patent Application No. 61/992,402, filed on May 13, 2014, entitled "System and Methods for Removing Errors in MALDI-TOF Spectrometers," which is hereby incorporated herein by reference in its entirety.

STATEMENT REGARDING FEDERALLY SPONSORED RESEARCH OR DEVELOPMENT

Not applicable.

BACKGROUND

Matrix assisted laser desorption time-of-flight (MALDI-TOF) mass spectrometers are highly robust and capable instruments for bio-molecular analysis. MALDI-TOF mass spectrometry has been applied for identification of bacterial and viral pathogens, clinical pathology, tissue imaging, biochemistry, health research, etc. Routine performance specifications for reflector MALDI-TOF instruments often exceed 15,000 for resolution and <5 ppm for accuracy with internal calibration. Higher level instruments may exceed these specifications. This performance is sufficient for most biological applications including protein identification by peptide mass fingerprinting, a technique that is highly dependent on high accuracy mass measurements of component peptides. For this reason, after resolutions exceeding 10,000 are attained, instrument accuracy is as important, if not more important, than resolution for most peptide and protein analyses.

SUMMARY

Despite the high accuracy and resolution performance for modern matrix assisted laser desorption time-of-flight (MALDI-TOF) instruments, many instruments demonstrate mass deviations from internally calibrated spectra significantly in excess of instrument specifications. For example, multiple spectra for the same peptide obtained within minutes of each other on the same instrument may exhibit errors ranging from under 1 ppm to 20 ppm or greater. These deviations are inconsistent and mass measurements for different peptides within a single mass spectrum often exhibit errors uncorrelated with other peptides in the spectrum. Further, there is no a priori method to define the accuracy of an unknown peptide mass measurement.

A system and method for MALDI-TOF mass spectrometry that overcomes the aforementioned shortcomings of conventional MALDI-TOF mass spectrometry are disclosed herein. In one embodiment, a method for MALDI-TOF mass spectrometry includes initiating a spectral analysis of a sample on a MALDI-TOF spectrometer. The sample is ionized, and a first ion spectrum is detected and stored. Thereafter, the spectrometer is reset, and the ionizing, detecting, storing, and resetting are repeated until a predetermined plurality of spectra of the sample is acquired.

In another embodiment, a MALDI-TOF mass spectrometry system includes a MALDI-TOF spectrometer and an analysis and control system coupled to the MALDI-TOF spectrometer. The MALDI-TOF spectrometer includes a laser, an ion detector, and a digitizer. The laser is configured to ionize a sample. The ion detector is configured to sense impacts of ions on the detector. The digitizer is configured to convert signal output of the detector to samples values. The analysis and control system configured to initiate acquisition of a plurality of spectra of the sample, to reset the MALDI-TOF spectrometer prior to initiation of acquisition of each of the spectra, and to generate a composite spectrum for the sample by statistically analyzing the plurality of spectra.

In a further embodiment, a MALDI-TOF processing system includes a processor and memory coupled to the processor. Analysis and control instructions are stored in the memory. When executed by the processor, the instructions cause the processor to: 1) initiate collection of a plurality of spectra of a sample by a MALDI-TOF spectrometer; 2) reset the MALDI-TOF spectrometer prior to initiation of collection of each of the spectra; 3) store the plurality of spectra in a storage device; and 4) generate a composite spectrum for the sample by statistically analyzing the stored plurality of spectra.

BRIEF DESCRIPTION OF THE DRAWINGS

For a more complete understanding of the present disclosure, reference is now made to the accompanying drawings and detailed written description, wherein like reference numerals represent like parts. In the accompanying drawings.

NOTATION AND NOMENCLATURE

Figure 1A:
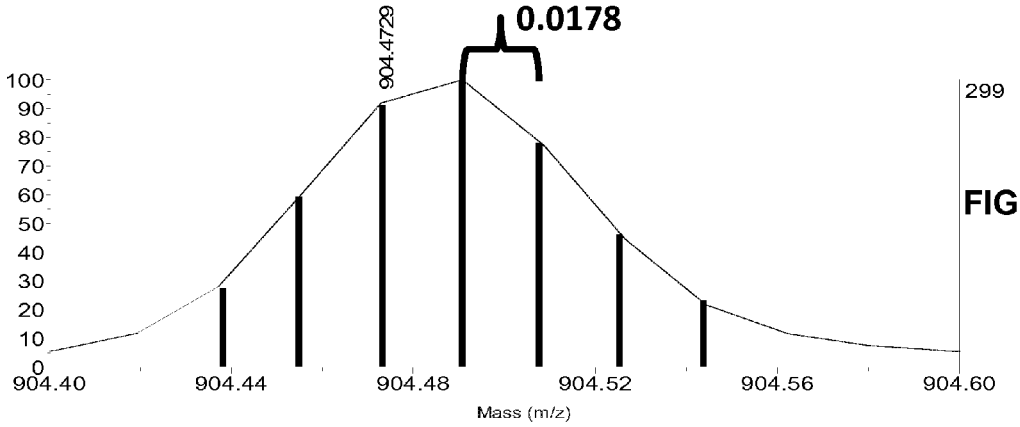
FIGS. 1A, 1B, and 1C show examples of discontinuous binning of ion impacts detected by a matrix assisted laser desorption time-of-flight (MALDI-TOF) mass spectrometer.

Certain terms are used throughout the following description and claims to refer to particular system components. As one skilled in the art will appreciate, companies may refer to a component by different names. This document does not intend to distinguish between components that differ in name but not function. In the following discussion and in the claims, the terms "including" and "comprising" are used in an open-ended fashion, and thus should be interpreted to mean "including, but not limited to . . . " Also, the term "couple" or "couples" is intended to mean either an indirect or direct connection. Thus, if a first device couples to a second device, that connection may be through a direct connection, or through an indirect connection via other devices and connections.

DETAILED DESCRIPTION

The following discussion is directed to various embodiments of the invention. Although one or more of these embodiments may be preferred, the embodiments disclosed should not be interpreted, or otherwise used, as limiting the scope of the disclosure, including the claims. In addition, one skilled in the art will understand that the following description has broad application, and the discussion of any embodiment is meant only to be exemplary of that embodiment, and not intended to intimate that the scope of the disclosure, including the claims, is limited to that embodiment.

Despite the high accuracy and resolution performance of conventional MALDI-TOF instruments, many instruments demonstrate mass deviations from internally calibrated spectra significantly in excess of instrument specifications. For example, multiple spectra for the same peptide obtained within minutes of each other on the same instrument may exhibit errors ranging from under 1 ppm to 20 ppm or greater. These deviations are inconsistent ,and mass measurements for different peptides within a single mass spectrum often exhibit errors uncorrelated with other peptides in the spectrum. Further, there is no a priori method to define the accuracy of an unknown peptide mass measurement.

A MALDI-TOF mass spectrometer uses an ion reflector to enhance instrument resolution and accuracy, enabling accurate mass measurements of peptides and molecules. Generally, a laser pulse ionizes a portion of the peptide sample and the time of flight between charged voltage plates and a reflector, also comprising charged voltage plates, is measured. The resulting data provides a spectrum of the peptide ion's mass over time and when data is processed, provides a quantitative analysis of the mass of ions in a sample. Further, multiple laser pulses may be used to increase the detection and spectral resolution of various peptide ions. Finally, the laser pulses for ionization may synchronize the internal clock for data acquisition.

Unfortunately, the data acquired from multiple spectra of the same peptide frequently demonstrate errors that exceed the manufacturers' claimed spectrometer specifications. Even when the variability in the peptides is evaluated to determine significance, for example via Shapiro-Wilk's test, and standard statistical methods are used to determine the characteristics of measurements either individual spectra or as a population thereof, the data demonstrates an unaccounted, significant variability. Altering the operation of the MALDI-TOF instrument by increasing the number of laser pulses or utilizing a different manufacturer's instrument, do not reduce the variability in the spectra obtained for the same peptide. These observations suggest that the factors affecting mass accuracy are systemic errors intrinsic to MALDI-TOF mass spectrometers and represent a barrier to repeatable, high-resolution, and accurate analysis and identification of biological peptides, proteins, and pathogens Generally, in a MALDI-TOF mass spectrometer, the raw data for the flight time of all ions in the spectrometer are converted from an analog signal and assigned to digital storage medium in regular intervals, called bins, by the analog-to-digital (A/D) system. The A/D system includes a detector and a converter. In operation, the ionized molecules impinge the detector and the converter translates these events into counts, or signal intensity, within a predetermined time or period defined by the A/D system at the start of acquisition of data. The detector and the converter may be configured to operate nearly simultaneously. More specifically, the A/D system measures the signal intensity at defined time intervals with a sampling rate defined by a high speed (500-1000 MHz or higher) internal clock. In operation, the A/D system measures the intensity of ions in discrete packets of signals in a period, and the period is defined by the A/D system internal clock.

Figure 1B:
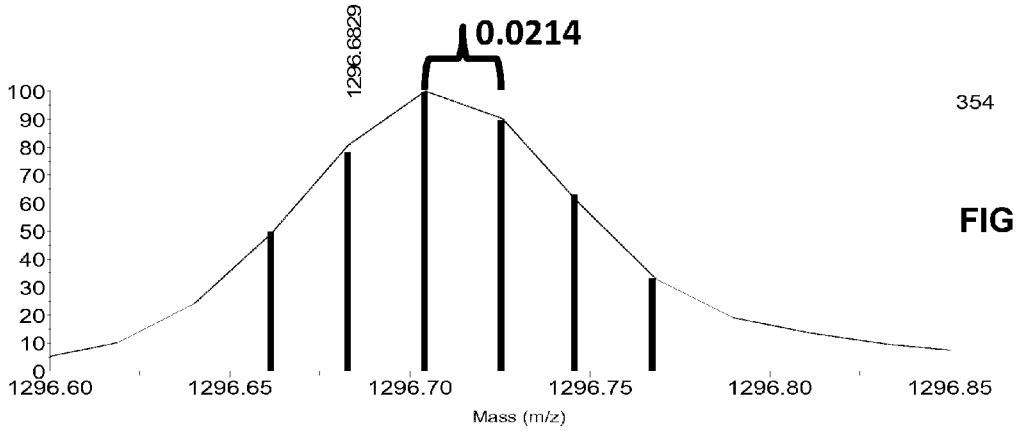
Figure 1C:
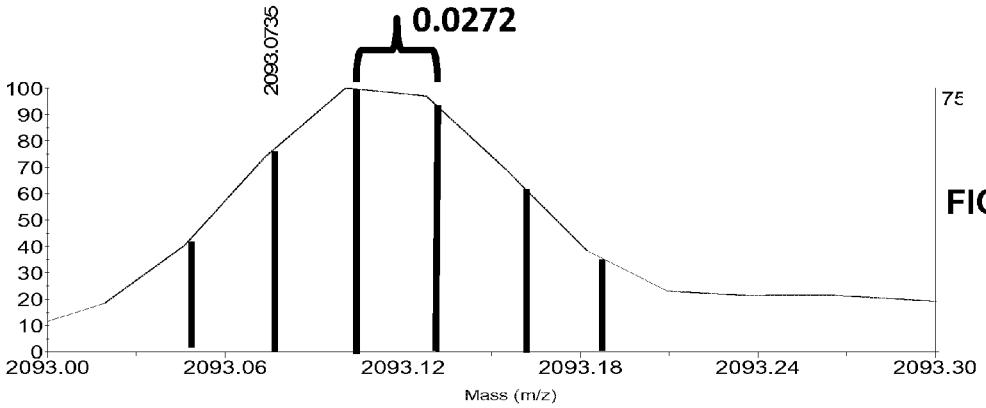

The packets of signals are subsequently stored in bins determined by the period of the internal clock. FIGS. 1A-1C show examples of peak shape in spectra that demonstrates discontinuous intensity measurements (i.e., bins) across every peak. The differences in bin spacing across the peaks of FIGS. 1A-1C are correlated with the difference in flight times for ions of different masses. The laser pulses for ionization synchronize the A/D system internal clock for acquisition. Accordingly, the start of acquisition defines the period range, thus setting the position of the bins relative to the laser pulse. All data acquired from subsequent laser pulses will be deposited into the same bins initially defined at the start of the acquisition.

Accordingly, a primary source of the variability in mass measurement derives from the discontinuous nature of measuring the flight time of ions by the analog-to-digital A/D system in the mass spectrometer. The resulting discontinuous raw time domain data results in discontinuous bins within the mass spectrum which require peak fitting for interpolation. In addition, the mass positions of the bins exhibit variation between spectra.

Imprecisions in timing of the laser pulses for ionization, or "jitter," can also significantly impact mass accuracy of MALDI-TOF instruments. Jitter interferes with the clustering of mass spectral data into discrete bins, resulting in peak broadening by imprecise binning. Peak broadening increases the deleterious impact of data binning during data processing and fitting algorithms that convert raw time-domain data into mass spectral data. Data processing and fitting algorithms interpolate important peak parameters including peak-width-at-half-maximum and the actual position of the apex of the peak from the discontinuous mass spectral data such as observed in FIGS. 1A-1C. Even minor variations in the measured bin intensities and their consideration in the fitting algorithms can significantly impact the best fitted interpolation of the peak. The jitter problem further exacerbates variability by broadening the measured data and increasing the number of bins necessary for interpolation. Thus, operation of a MALDI-TOF mass spectrometer may inherently include the aforementioned systemic sources of random error, as well as other errors.

The present disclosure is directed to reconfiguring a MALDI-TOF mass spectrometer for mitigating systemic random errors from data collection. Further, reconfiguring a MALDI-TOF mass spectrometer includes a multi-step process for implementing multiple data acquisitions, collecting spectra from each acquisition, and generating a composite spectrum. This process relates to resetting the spectrometer, for example between each data acquisition. Accordingly, resetting the spectrometer may include a partial reset, such that the A/D system is reset, without resetting or depowering the laser, voltage plates, or data processors. Resetting the A/D system randomly repositions the bins for each spectrum within the electronic error of the system, thus randomly shifting the interpolated peaks with the mass spectrum. Averaging large numbers of individual spectra exploit this effect to provide enhanced consistency and accuracy for the MALDI-TOP instrument. A MALDI-TOF mass spectrometer configured accordingly provides an efficient platform for improving accuracy during high-resolution analysis of samples. More specifically, the system acquisition software, rather than a user, may conduct additional calculations to determine if the variability of the systemic error is acceptable. Embodiments disclosed herein exploit the combined effects of jitter and electronic variability in the A/D detector system to provide random repositioning of the data bin positions by restarting the acquisition. Statistical mapping of the population of data provides more accurate mass measurements than individual spectra can reliably achieve.

For example, in an embodiment, data acquired from 10 or more replicate measurements and analyzed using descriptive statistics provide more consistent and accurate data with the possibility of a priori identification of mass measurements exhibiting greater probability of error than is possible using convention MALDI-TOF mass spectrometry. In contrast, increases in laser pulses for each spectrum do not improve accuracy appreciably. Spectral averaging resolves multiple underlying mechanisms contributing to variability in these instruments including discontinuous measurements of the time-of-flight data for ions resulting in binning of data in the mass spectrometer, laser timing imprecision (jitter), and likely peak fitting algorithms required for converting discontinuous time-domain data into mass-domain data.

An illustrative MALDI-TOF resetting system may include an acquisition engine, a collection engine, and an analysis engine. The acquisition engine initializes the collection of a first spectrum from a sample, including activating the laser pulse and the A/D system. The collection engine stores the first spectrum, and resets the acquisition engine. After a predetermined number ("n," any positive integer) of spectra are collected, the analysis engine provides statistical analysis, including but not limited to, averaging of the collected spectra. In general, the analysis engine may be configured to mark, annotate, or remove spectra that have characteristics outside a predetermined or expected range, such as but not limited to, a standard deviation. In some configurations, the acquisition engine, collection engine, and analysis engine may be implemented as a processor executing software modules. More specifically, the MALDI-TOF resetting system may include software modules that partially reset a MALDI-TOF mass spectrometer in order to minimize or eliminate random error from the A/D system operation.

For example, a user input or computer signal may initiate the operation of a MALDI-TOF mass spectrometer. Acquiring a spectrum from a sample includes activating a laser, detecting the molecular impacts, and binning the number of impacts in bins to form a first spectrum. Collecting the spectra comprises storing the first spectrum on a storage medium. Additionally, once the spectrum is stored, the spectrometer, or a component thereof, is reset. After resetting, another spectrum from the sample is acquired. Resetting and acquiring spectra from the sample continue until a predetermined number of spectra are stored. Analyzing the stored spectra comprises averaging the spectra and statistical mapping of the spectra data. Without limitation by any particular theory, analyzing the stored spectra comprises averaging out random systemic errors and identifying outliers through statistical analysis.

Figure 2:
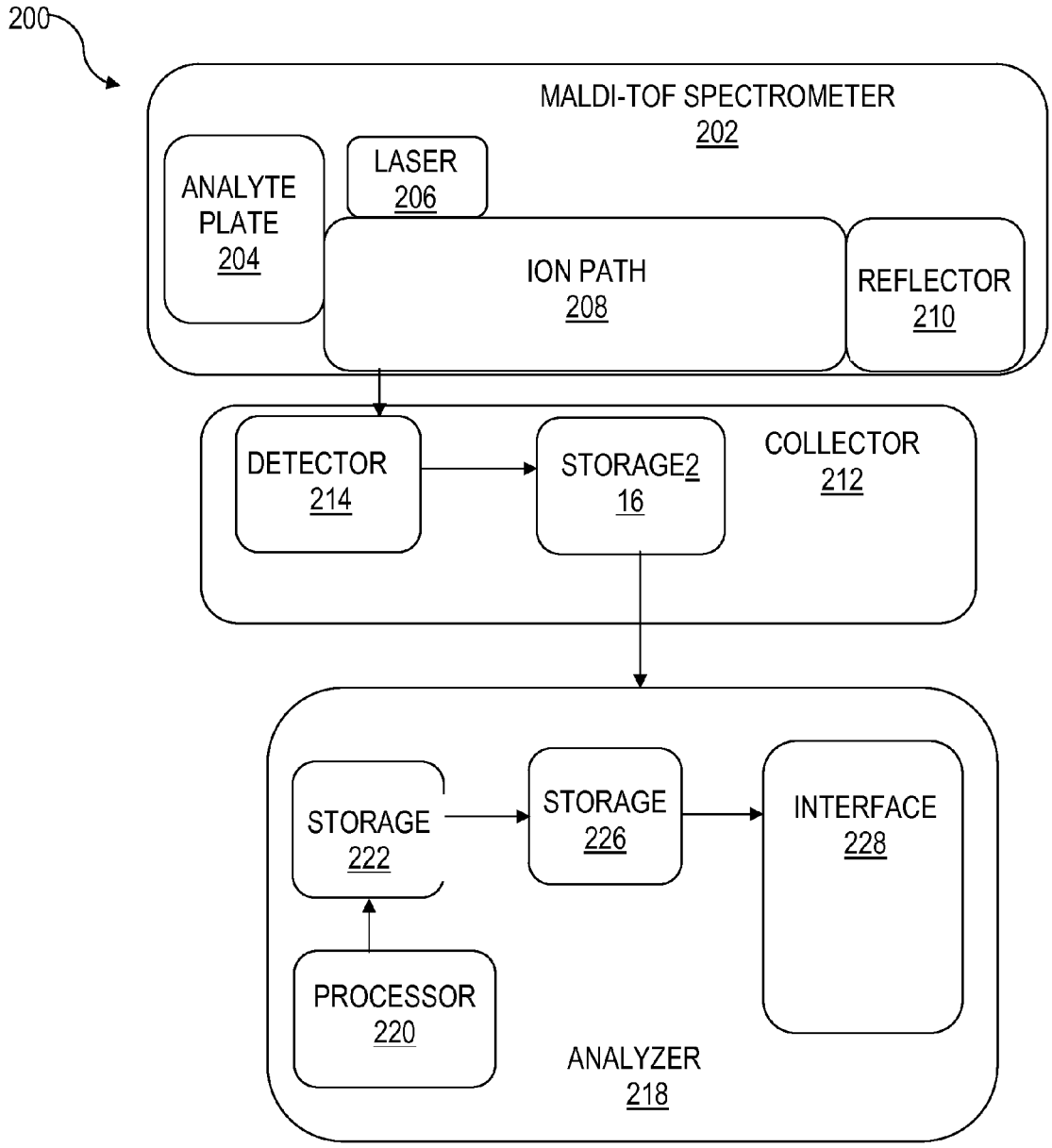
FIG. 2 illustrates an exemplary schematic for a MALDI-TOF mass spectrometer system according to principles disclosed herein.

FIG. 2 shows an exemplary schematic for a mass spectrometer system 200 according to the present disclosure. The system 200 comprises a spectrometer 202, a collector 212, and an analyzer 218. The spectrometer 202 generally comprises an analyte plate 204, a laser 206, an ion path 208 and a reflector 210. Generally, the ion path 208 and the reflector 210 include voltage plates configured and acting as ion lenses. The collector 212 includes a detector 214 and a first storage medium 216. The analyzer 218 comprises a computer, having a processor 220, a second storage medium 222, a third storage medium 226, and an interface 228. Generally, the interface 228 may include a computer display, keyboard, and remote pointing device, such as a mouse.

Figure 3:
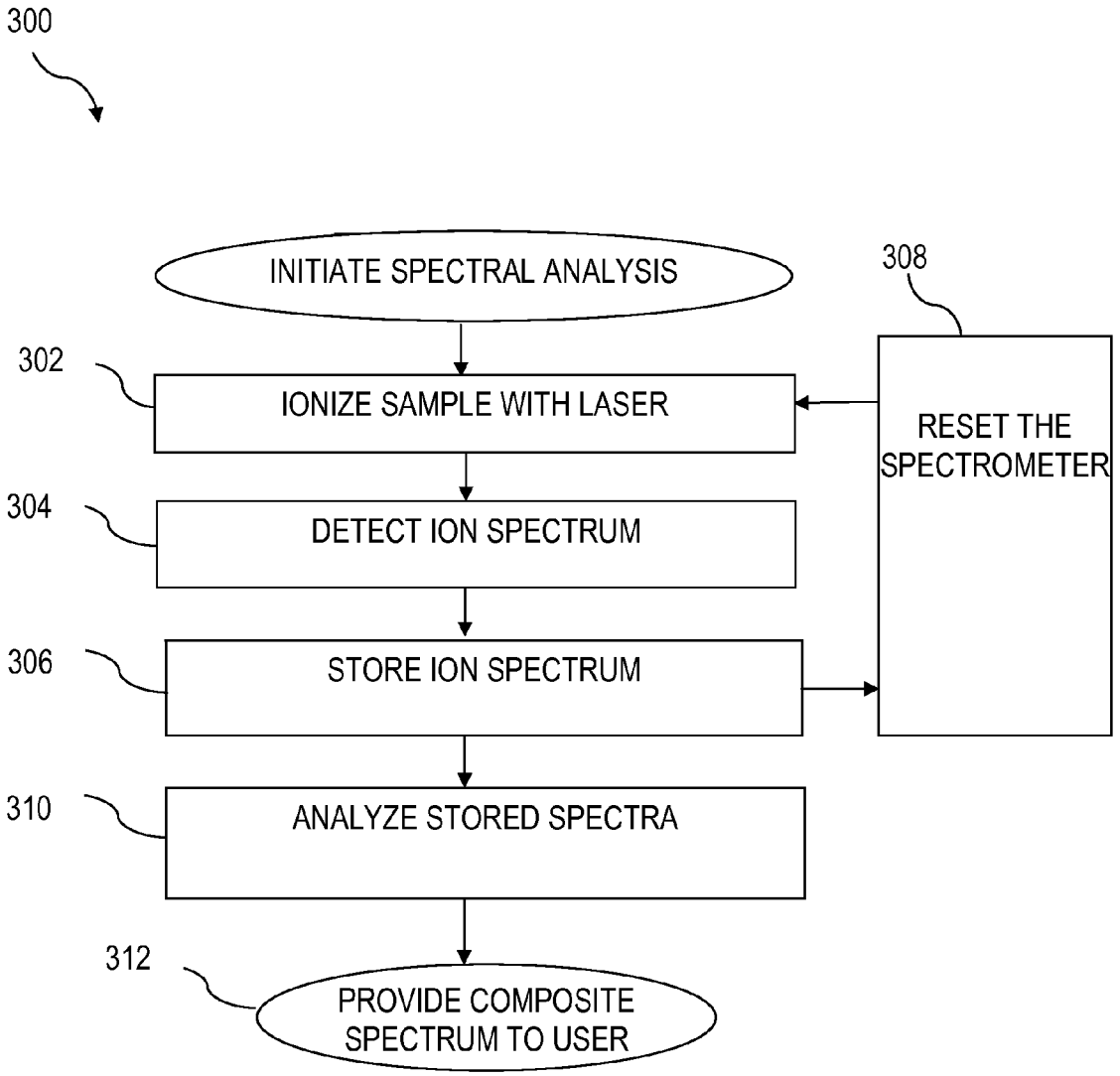
FIG. 3 illustrates an exemplary schematic of the method for operating a mass spectrometer system according to principles disclosed herein.

FIG. 3 shows an exemplary method 300 for operating a mass spectrometer system 200 such as is illustrated in FIG. 1. Though depicted sequentially as a matter of convenience, at least some of the actions shown may be performed in a different order and/or performed in parallel. Additionally, some embodiments may perform only some of the actions shown. In some embodiments, at least some operations of the method 300, as well as other operations described herein, can be implemented as instructions stored in a computer-readable medium and executed by one or more processors.

Conventionally, MALDI-TOF mass spectrometers ionize samples, detect the ion molecules, store the samples on a processing device, and repeat the experiment without resetting the device or any system therein. Thus, any random system errors are intrinsically found throughout all the spectra of that data. In contrast, the method 300 includes, in block 302, initiating a spectral analysis by ionizing the sample with a laser 206. In block 304 the detector 214 detects ion molecule impacts as a spectrum. The spectrum is stored in block 306. The spectrometer 202 is reset in block 308. After a predetermined number of spectra are stored, the method 300 comprises analyzing the stored spectra, in block 310, to generate a composite spectrum for the sample. In block 312, the composite spectrum is provided to a user. In the method 300, resetting the spectrometer 202 before each spectrum acquisition randomizes systemic errors, such that statistical analysis will mitigate or average out the random errors during analysis of the stored spectra.

More specifically, ionizing the sample, in block 302, also activates the internal clock of the spectrometer 202. The activated clock provides the start time for detecting ion-molecule impacts in block 304. Additionally, the activated clock sets the data collection periods, or bins, for detecting ion molecule impacts in block 304 and assigning the ion molecule counts within each bin. Storing the spectrum, in block 306, includes temporarily preserving the binned ion molecule counts, for example on the first storage medium 216 described hereinabove. Resetting the spectrometer, in block 308, further includes repeating the steps of ionizing the sample with the laser 206 in block 302, detecting ion molecule impacts on the detector 214 as a spectrum in block 304, and storing the spectrum in block 306. After a predetermined number of spectra are stored, analyzing the stored spectra in block 310 includes statistically analyzing the spectra. Without limitation by any particular theory, analyzing the spectra further includes averaging the binned data. Providing the stored spectra to a user in block 312 includes providing the user the analyzed spectrum, or a more specifically a composite spectrum. The composite spectrum generally includes the averaged spectra, or alternatively, the averaged spectra are further processed by a user-specified algorithm. In some instances, a user-specified algorithm may alter the binning periods or the detector sensitivity to ion molecule impacts in order to alter the statistical mapping of each spectrum's data.

Figure 4:
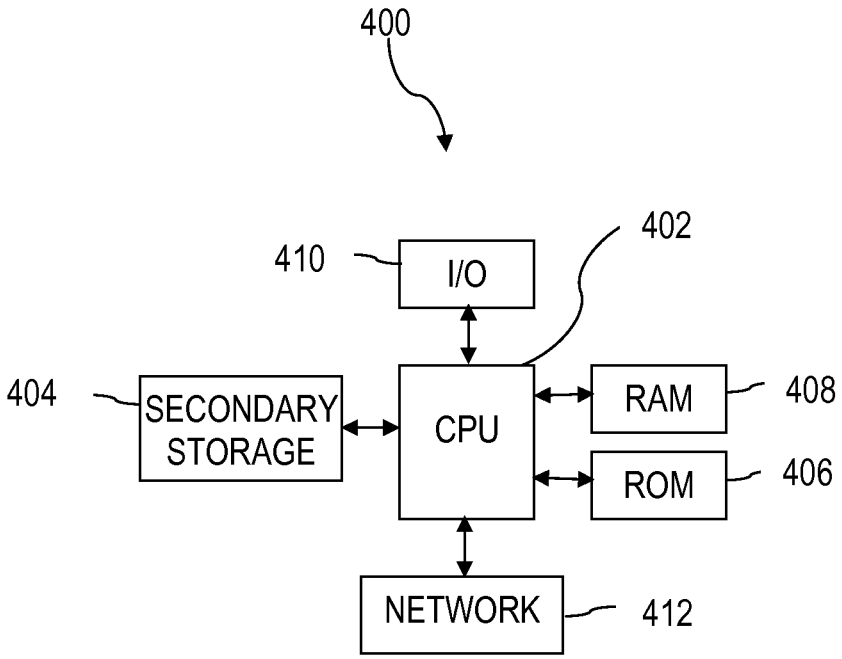
FIG. 4 illustrates an exemplary system suitable for implementation of an analyzer used in mass spectrometer system according to principles disclosed herein.

FIG. 4 illustrates a computer system 400 suitable for implementing one or more embodiments disclosed herein, for example the analyzer 218. The computer system 400 includes a processor 402, which may be referred to as a central processor unit, a computer processor unit, or a CPU. The processor 402 is in communication with memory devices including secondary storage 404, read only memory (ROM) 406, random access memory (RAM) 408, input/output (I/O) devices 410, and network connectivity devices 412. The processor 402 may be implemented as one or more central processor units or chips.

It is understood that by programming and/or loading executable instructions, onto the computer system 400, at least one of the central processing unit 402, the random access memory 408, and the read only memory 406 are changed, transforming the computer system 400 in part into a particular machine or apparatus having the novel functionality taught by the present disclosure. It is fundamental to the electrical engineering and software engineering arts that functionality that can be implemented by loading executable software into a computer can be converted to a hardware implementation by well-known design principles. Decisions between implementing a concept in software versus hardware typically hinge on considerations of stability of the design and numbers of units to be produced rather than any issues involved in translating from the software domain to the hardware domain. Generally, a design that is still subject to frequent change may be preferred to be implemented in software, because re-spinning a hardware implementation is more expensive than re-spinning a software design. Generally, a design that is stable that will be produced in large volume may be preferred to be implemented in hardware, for example in an application specific integrated circuit (ASIC), because, for large production runs, the hardware implementation may be less expensive than the software implementation. Often a design may be developed and tested in a software form and later transformed, by well-known design principles, to an equivalent hardware implementation in an application-specific integrated circuit that hardwires the instructions of the software. In the same manner as a machine controlled by a new ASIC is a particular machine or apparatus, likewise a computer that has been programmed and/or loaded with executable instructions may be viewed as a particular machine or apparatus.

The secondary storage 404 is typically comprised of one or more disk drives or tape drives and is used for non-volatile storage of data and as an over-flow data storage device if random access memory 408 is not large enough to hold all working data. Secondary storage 404 may be used to store programs which are loaded into random access memory 408 when such programs are selected for execution. The read only memory 406 is used to store instructions and perhaps data which are read during program execution. Read only memory 406 is a non-volatile memory device which typically has a small memory capacity relative to the larger memory capacity of secondary storage 404. The random access memory 408 is used to store volatile data and perhaps to store instructions. Access to both read only memory 406 and random access memory 408 is typically faster than to secondary storage 404. The secondary storage 404, the random access memory 408, and/or the read only memory 406 may be referred to in some contexts as computer readable storage media and/or non-transitory computer readable media. Input/output devices 410 may include printers, video monitors, liquid crystal displays (LCDs), touch screen displays, keyboards, keypads, switches, dials, mice, track balls, voice recognizers, card readers, paper tape readers, or other well-known input devices.

The network connectivity devices 412 may take the form of modems, modem banks, Ethernet cards, universal serial bus (USB) interface cards, serial interfaces, token ring cards, fiber distributed data interface (FDDI) cards, wireless local area network (WLAN) cards, radio transceiver cards such as code division multiple access (CDMA), global system for mobile communications (GSM), long-term evolution (LTE), worldwide interoperability for microwave access (WiMAX), and/or other air interface protocol radio transceiver cards, and other well-known network devices. These network connectivity devices 412 may enable the processor 402 to communicate with the Internet, one or more intranets, one or more users, and the mass spectrometer, including any high-capacity proprietary components or media. With such a network connection, it is contemplated that the processor 402 might receive information from the network, or might output information to the network in the course of performing the above-described method steps. Such information, which is often represented as a sequence of instructions to be executed using the processor 402, may be received from and output to the network, for example, in the form of a computer data signal embodied in a carrier wave.

Such information, which may include data or instructions to be executed using the processor 402 for example, may be received from and output to the network, for example, in the form of a computer data baseband signal or signal embodied in a carrier wave. The baseband signal or signal embedded in the carrier wave, or other types of signals currently used or hereafter developed, may be generated according to several methods well known to one skilled in the art. The baseband signal and/or signal embedded in the carrier wave may be referred to in some contexts as a transitory signal. The processor 402 executes instructions, codes, computer programs, scripts, etc. which the processor 402 accesses from hard disk, floppy disk, optical disk, such that these various disk based systems may all be considered secondary storage 404, or read only memory 406, random access memory 408, or the network connectivity devices 412. While only one processor 402 is shown, multiple processors may be present. Thus, while instructions may be discussed as executed by a processor, the instructions may be executed simultaneously, serially, or otherwise executed by one or multiple processors. Instructions, codes, computer programs, scripts, and/or data that may be accessed from the secondary storage 404, for example, hard drives, floppy disks, optical disks, and/or other device, the read only memory 406, and/or the random access memory 408 may be referred to in some contexts as non-transitory instructions and/or non-transitory information.

In an embodiment, the computer system 400 may comprise two or more computers or servers in communication with each other that collaborate to perform a task. For example, but not by way of limitation, an application may be partitioned in such a way as to permit concurrent and/or parallel processing of the instructions of the application. Alternatively, the data processed by the application may be partitioned in such a way as to permit concurrent and/or parallel processing of different portions of a data set by the two or more computers or servers. In an embodiment, virtualization software may be employed by the computer system 400 to provide the functionality of a number of servers that is not directly bound to the number of computers in the computer system 400. For example, virtualization software may provide twenty virtual servers on four physical computers. In an embodiment, the functionality disclosed above may be provided by executing the application and/or applications in a cloud computing environment. Cloud computing may comprise providing computing services via a network connection using dynamically scalable computing resources. Cloud computing may be supported, at least in part, by virtualization software. A cloud computing environment may be established by an enterprise and/or may be hired on an as-needed basis from a third party provider. Some cloud computing environments may comprise cloud computing resources owned and operated by the provider or another enterprise, as well as cloud computing resources hired and/or leased from a third party provider.

In an embodiment, some or all of the functionality disclosed above may be provided as a computer program product. The computer program product may comprise one or more computer readable storage medium having computer usable program code embodied therein to implement the functionality disclosed above. The computer program product may comprise data structures, executable instructions, and other computer usable program code. The computer program product may be embodied in removable computer storage media and/or non-removable computer storage media. The removable computer readable storage medium may comprise, without limitation, a paper tape, a magnetic tape, magnetic disk, an optical disk, a solid state memory chip, for example analog magnetic tape, compact disk read only memory (CD-ROM) disks, floppy disks, jump drives, digital cards, multimedia cards, and others. The computer program product may be suitable for loading, by the computer system 400, at least portions of the contents of the computer program product to the secondary storage 404, to the read only memory 406, to the random access memory 408, and/or to other non-volatile memory and volatile memory of the computer system 400 disclosed herein. The processor 402 may process the executable instructions and/or data structures in part by directly accessing the computer program product, for example by reading from a compact disk-read only memory disk (CD-ROM disk) inserted into a disk drive peripheral of the computer system 400. Alternatively, the processor 402 may process the executable instructions and/or data structures by remotely accessing the computer program product, for example by downloading the executable instructions and/or data structures from a remote server through the network connectivity devices 412. The computer program product may comprise instructions that promote the loading and/or copying of data, data structures, files, and/or executable instructions to the secondary storage 404, to the read only memory 406, to the random access memory 408, and/or to other non-volatile memory and volatile memory of the computer system 400.

In some contexts, the secondary storage 404, the read only memory (ROM) 406, and the random access memory (RAM) 408 may be referred to as a non-transitory computer readable medium or a computer readable storage media. A dynamic RAM embodiment of the RAM 408, likewise, may be referred to as a non-transitory computer readable medium in that while the dynamic RAM receives electrical power and is operated in accordance with its design, for example during a period of time during which the computer 400 is turned on and operational, the dynamic RAM stores information that is written to it. Similarly, the processor 402 may comprise an internal RAM, an internal ROM, a cache memory, and/or other internal non-transitory storage blocks, sections, or components that may be referred to in some contexts as non-transitory computer readable media or computer readable storage media.

While several embodiments have been described in the present disclosure, it should be understood that the disclosed systems and methods may be embodied in many other specific forms without departing from the spirit or scope of the present disclosure. The present examples are to be considered as illustrative and not restrictive. For example, the various elements or components may be combined or integrated in another system or certain features may be omitted or not implemented.

Variations, combinations, and/or modifications of the embodiment(s) and/or features of the embodiment(s) disclosed herein are within the scope of the disclosure. Alternative embodiments that result from combining, integrating, and/or omitting features of the embodiment(s) are also within the scope of the disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, $R_l$, and an upper limit, $R_u$, is disclosed, any number falling within the range is specifically disclosed. In particular, the following numbers within the range are specifically disclosed: $R=R_l+k*(R_u-R_l)$, wherein k is a variable ranging from 1 percent to 100 percent with a 1 percent increment, i.e., k is 1 percent, 2 percent, 3 percent, 4 percent, 5 percent, . . . 50 percent, 51 percent, 52 percent . . . 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim means that the element is required, or alternatively, the element is not required, both alternatives being within the scope of the claim. Use of broader terms such as "comprises", "includes", and "having" should be understood to provide support for narrower terms such as "consisting of", "consisting essentially of", and "comprised substantially of". Accordingly, the scope of protection is not limited by the description set out above but is defined by the claims that follow, that scope including all equivalents of the subject matter of the claims. Each and every claim is incorporated as further disclosure into the specification, and the claims are exemplary embodiment(s) of the present invention. The discussion of a reference in the disclosure is not an admission that it is prior art, especially any reference that has a publication date after the priority date of this application. The disclosure of all patents, patent applications, and publications cited in the disclosure are hereby incorporated by reference, to the extent that they provide exemplary, procedural or other details supplementary to the disclosure.

What is claimed is:

1. A method for matrix assisted laser desorption time-of-flight (MALDI-TOF) mass spectrometry, comprising:

initiating a spectral analysis of a sample on a MALDI-TOF spectrometer;

ionizing the sample;

detecting a first ion spectrum;

storing the first ion spectrum;

resetting the spectrometer, wherein the resetting randomly repositions bins for spectral data produced by digitization in the spectrometer; and repeating the ionizing, detecting, storing, and resetting until a predetermined plurality of spectra of the sample is acquired.

2. The method of claim 1, further comprising:

statistically analyzing the stored spectra; and generating a composite spectrum.

3. The method of claim 2, wherein generating the composite spectrum comprises statistically averaging the stored spectra.

4. The method of claim 2, wherein the analyzing comprises:

identifying spectra that have characteristics outside of a predetermined range; and excluding the identified spectra from the composite spectrum.

5. The method of claim 1, wherein:

the ionizing comprises activating a laser; and the detecting comprises detecting impact of ions on a detector plate and counting the impacts; and the storing comprises arranging the count of impacts in bins.

6. The method of claim 1, wherein resetting the spectrometer comprises resetting an analog to digital conversion system of the spectrometer.

7. The method of claim 1, wherein resetting does not include resetting a laser, or a voltage plate of the spectrometer.

8. The method of claim 1, wherein the resetting randomized error introduced in the spectra by the MALDI TOF spectrometer.

9. The method of claim 1, wherein the resetting provides random repositioning of bins to which spectra are assigned.

10. The method of claim 1, wherein the predetermined number of spectra is at least 10.

11. A matrix assisted laser desorption time-of-flight (MALDI-TOF) mass spectrometry system, comprising:

a MALDI-TOF spectrometer comprising:

a laser configured to ionize a sample;

an ion detector configured to sense impacts of ions on the detector;

a digitizer configured to convert signal output of the detector to samples values; and an analysis and control system coupled to the MALDI-TOF spectrometer, the analysis and control system configured to:

initiate acquisition of a plurality of spectra of the sample;

reset the MALDI-TOF spectrometer prior to initiation of acquisition of each of the spectra, wherein resetting the MALDI-TOF spectrometer randomly repositions bins for each spectra produced by digitization in the MALDI-TOF spectrometer; and generate a composite spectrum for the sample by statistically analyzing the plurality of spectra.

12. The MALDI-TOF mass spectrometry system of claim 11, wherein the analysis and control system is configured to generate the composite spectrum for the sample by statistically averaging the plurality of spectra.

13. The MALDI-TOF mass spectrometry system of claim 11, wherein the analysis and control system is configured to generate the composite spectrum for the sample by:

identifying spectra that have characteristics outside of a predetermined range; and excluding the identified spectra from the composite spectrum.

14. The MALDI-TOF mass spectrometry system of claim 11, wherein the analysis and control system is configured to reset the digitizer as part of the reset of the MALDI-TOF spectrometer.

15. The MALDI-TOF mass spectrometry system of claim 11, wherein the analysis and control system is configured to, via the reset of the MALDI-TOF spectrometer, randomize error introduced in the spectra by the MALDI-TOF spectrometer.

16. The MALDI-TOF mass spectrometry system of claim 11, wherein the analysis and control system is configured to not reset or remove power from the laser and voltage plates of the MALDI-TOF spectrometer as part of the reset of the MALDI-TOF spectrometer.

17. A matrix assisted laser desorption time-of-flight (MALDI-TOF) processing system, comprising:

a processor;

a memory coupled to the processor; and analysis and control instructions stored in the memory that, when executed by the processor, cause the processor to:

initiate collection of a plurality of spectra of a sample by a MALDI-TOF spectrometer;

reset the MALDI-TOF spectrometer prior to initiation of collection of each of the spectra, wherein resetting the MALDI-TOF spectrometer randomly repositions bins for each spectra produced by digitization in the MALDI-TOF spectrometer;

store the plurality of spectra in a storage device; and generate a composite spectrum for the sample by statistically analyzing the stored plurality of spectra.

18. The MALDI-TOF processing system of claim 17, wherein the analysis and control instructions, when executed by the processor, cause the processor to generate the composite spectrum for the sample by statistically averaging the stored plurality of spectra.

19. The MALDI-TOF processing system of claim 17, wherein the analysis and control instructions, when executed by the processor, cause the processor to, as part of generation of the composite spectrum for the sample:

identify, in the stored plurality of spectra, spectra that have characteristics outside of a predetermined range; and exclude the identified spectra from the composite spectrum.

20. The MALDI-TOF processing system of claim 17, wherein the analysis and control instructions, when executed by the processor, cause the processor to, as part of the reset of the MALDI-TOF spectrometer:

reset a digitizer of the MALDI-TOF spectrometer; and not reset or remove power from a laser or voltage plates of the MALDI-TOF spectrometer.

* * * * *